US007832174B2

(12) United States Patent
Way

(10) Patent No.: US 7,832,174 B2
(45) Date of Patent: Nov. 16, 2010

(54) MULTI-STOREY INSULATED CONCRETE FORM STRUCTURE AND METHOD OF CONSTRUCTION

(76) Inventor: Alven J. Way, 201 Corrie Cresent, Waterloo, Ontario (CA) N2L 5W5

( * ) Notice: Subject to any disclaimer, the term of this patent is extended or adjusted under 35 U.S.C. 154(b) by 0 days.

(21) Appl. No.: 11/872,319

(22) Filed: Oct. 15, 2007

(65) Prior Publication Data

US 2009/0094935 A1 Apr. 16, 2009

(51) Int. Cl.
*E04B 1/00* (2006.01)

(52) U.S. Cl. ..... 52/742.14; 52/236.6; 52/236.8; 52/259; 52/745.09

(58) Field of Classification Search ..... 52/741.13, 52/295, 426, 745.09, 745.05, 236.8, 236.7, 52/251, 259, 236.6, 431, 562, 565, 742.14, 52/745.1, 266, 264; 264/31, 35
See application file for complete search history.

(56) References Cited

U.S. PATENT DOCUMENTS 4,616,459 A * 10/1986 Shubow ..... 52/309.12
4,669,240 A * 6/1987 Amormino ..... 52/236.6
4,924,641 A * 5/1990 Gibbar, Jr. ..... 52/204.1
5,038,541 A * 8/1991 Gibbar, Jr. ..... 52/295
5,040,344 A * 8/1991 Durand ..... 52/127.2
5,107,648 A * 4/1992 Roby ..... 52/309.12
5,488,806 A * 2/1996 Melnick et al. ..... 52/425
5,570,550 A * 11/1996 Roby ..... 52/309.12
5,657,600 A * 8/1997 Mensen ..... 52/426
5,809,727 A * 9/1998 Mensen ..... 52/426
6,438,918 B2 * 8/2002 Moore et al. ..... 52/426
6,481,178 B2 * 11/2002 Moore, Jr. ..... 52/741.13
6,739,102 B2 * 5/2004 Roy, Sr. ..... 52/294

(Continued)

FOREIGN PATENT DOCUMENTS

CA 1283793 C 5/1991

(Continued)

OTHER PUBLICATIONS

Excerpt from a 1969 textbook, "Modern Carpentry" by Willis H. Wagner, Best Available Copy.

(Continued)

*Primary Examiner*—David Dunn
*Assistant Examiner*—Joshua Ihezie
(74) *Attorney, Agent, or Firm*—Etienne de Villiers; Dimock Stratton LLP

(57) ABSTRACT

A method of constructing one or more storeys of a multi-storey insulated concrete form structure using insulated forms and a multi-storey insulated concrete form structure built using the method. An aspect of the method comprises erecting a set of forms comprising an inner form and an outer form a set distance apart, the outer form extending higher than the inner form when erected. Pouring concrete between the forms upto an upper portion of the inner form and allowing the concrete to set creating a first concrete bearing surface. Positioning a floor on the first concrete bearing surface above the inner form. Pouring concrete between the floor and the outer form to an upper portion of the outer form and allowing the concrete to set creating a second bearing surface substantially in-line with the upper portion of the outer form.

4 Claims, 5 Drawing Sheets

U.S. PATENT DOCUMENTS

| | | | | |
|---|---|---|---|---|
| 2002/0017070 | A1* | 2/2002 | Batch | 52/309.11 |
| 2002/0100247 | A1* | 8/2002 | Lai | 52/742.14 |
| 2002/0116888 | A1* | 8/2002 | Jorn et al. | 52/426 |
| 2005/0210785 | A1* | 9/2005 | Way | 52/295 |
| 2009/0095878 | A1* | 4/2009 | Way | 249/132 |

FOREIGN PATENT DOCUMENTS

| | | | |
|---|---|---|---|
| CA | 2104471 | A1 | 9/1992 |
| CA | 1312477 | C | 1/1993 |
| CA | 1314727 | C | 3/1993 |
| CA | 1326769 | C | 2/1994 |
| CA | 2204558 | A1 | 12/1997 |
| CA | 2315638 | A1 | 7/1999 |
| CA | 2382279 | A1 | 3/2001 |
| CA | 2399300 | A1 | 10/2001 |
| CA | 2343609 | A1 | 3/2002 |
| CA | 2512211 | A1 | 7/2004 |
| CA | 2499971 | C | 9/2005 |
| CA | 2566545 | A1 | 9/2005 |
| CA | 2566566 | A1 | 9/2005 |

OTHER PUBLICATIONS

Drawing provided by Sto Corporation, dated Jun. 2003, Best Available Copy.

Quad-Lock Building Systems Ltd. dated Nov. 8, 2003, Best Available Copy.

Technical documentation of Arxx Building Products dated Oct. 2000, Best Available Copy.

* cited by examiner

MULTI-STOREY INSULATED CONCRETE FORM STRUCTURE AND METHOD OF CONSTRUCTION

FIELD OF THE INVENTION

This invention relates to insulated concrete form construction methods and walls and buildings constructed using insulated concrete forms.

BACKGROUND OF THE INVENTION

Insulated concrete form (ICF) construction techniques typically involve fixing two foam forms a fixed distance apart and pouring concrete between the forms. After the concrete has set, the foam forms remain in place to provide insulation for the concrete structure. Reinforcing members, such as rebar or mesh, may be located in the gap between the forms before the pour to become embedded in the concrete and provide reinforcement to the structure after the concrete sets.

Depending upon the application, the foam forms may require additional support to ensure their alignment is maintained during the pour since the concrete is considerably heavier than the foam forms and the bottom of the forms experiences a hydrostatic force imparted by the total height of concrete poured. Supporting the foam forms in some fashion is often required to prevent the concrete from forcing the forms out of alignment resulting in misaligned structures or surfaces of the structures that don't follow the intended surface line of the foam forms.

Foam forms for ICF construction typically have ties that hold the two foam layers a set distance apart during the concrete pour. An example of a suitable foam form are Nudura (trade-mark) forms, though other suitable forms are also commercially available comprising a high enough density and appropriate chemical formula to meet the fire requirements. While the present application only illustrates straight foam forms for straight walls comprising two planar rectangular foam layers for ease of illustration, forms for alternate wall configurations including angles, corners and curves may also similarly be used.

Multi-storey concrete structures have traditionally not been constructed using ICF due to the difficulties in maintaining alignment of the forms during the pour. While ICF is used for construction near ground level, inaccuracies in alignment tend to become exaggerated with each additional storey of construction making their use in multi-storey structures more problematic. Deviations in the forms during the pour require repairs to the foam and concrete structure that are difficult, time consuming and expensive.

One aspect of the difficulties faced in building multi-storey concrete structures using ICF construction techniques has been the lack of ready access to the outside of the structure during construction above the first storey. Another aspect of the difficulties faced in building multi-storey concrete structures using ICF construction techniques has been the difficulty in anchoring and supporting the outer surface of the structure during construction above the first storey.

A method of ensuring alignment of forms at ground level during the pour has been to secure supplementary supports about the external surface of the forms to provide additional support and maintain them in alignment. At ground level supplementary supports are typically anchored to the ground. One common type of supplementary support is constructed from two sets of wooden boards with metal ties maintaining the distance between the sets of boards. Supports of this kind are relatively expensive and time-consuming to use in ICF construction for multi-storey structures.

A method of ensuring alignment of forms in multi-storey structures has been to tie the outer form into support members previously cast into set concrete. One difficulty with this method is the time taken to tie the forms into the support members. Another difficulty with this method is ensuring the outer form is sufficiently supported to withstand the pressure of a concrete pour without having the forms become misaligned.

There is a need for a system and method of ICF construction that avoids the difficulties faced with current construction techniques.

There is a further need for a system and method of ICF construction that results in each storey of an ICF structure under construction being a stable storey capable of supporting additional higher storeys for construction.

BRIEF DESCRIPTION OF THE DRAWINGS

In drawings which illustrate by way of example only a preferred embodiment of the invention.

DETAILED DESCRIPTION OF THE INVENTION

Figure 1:
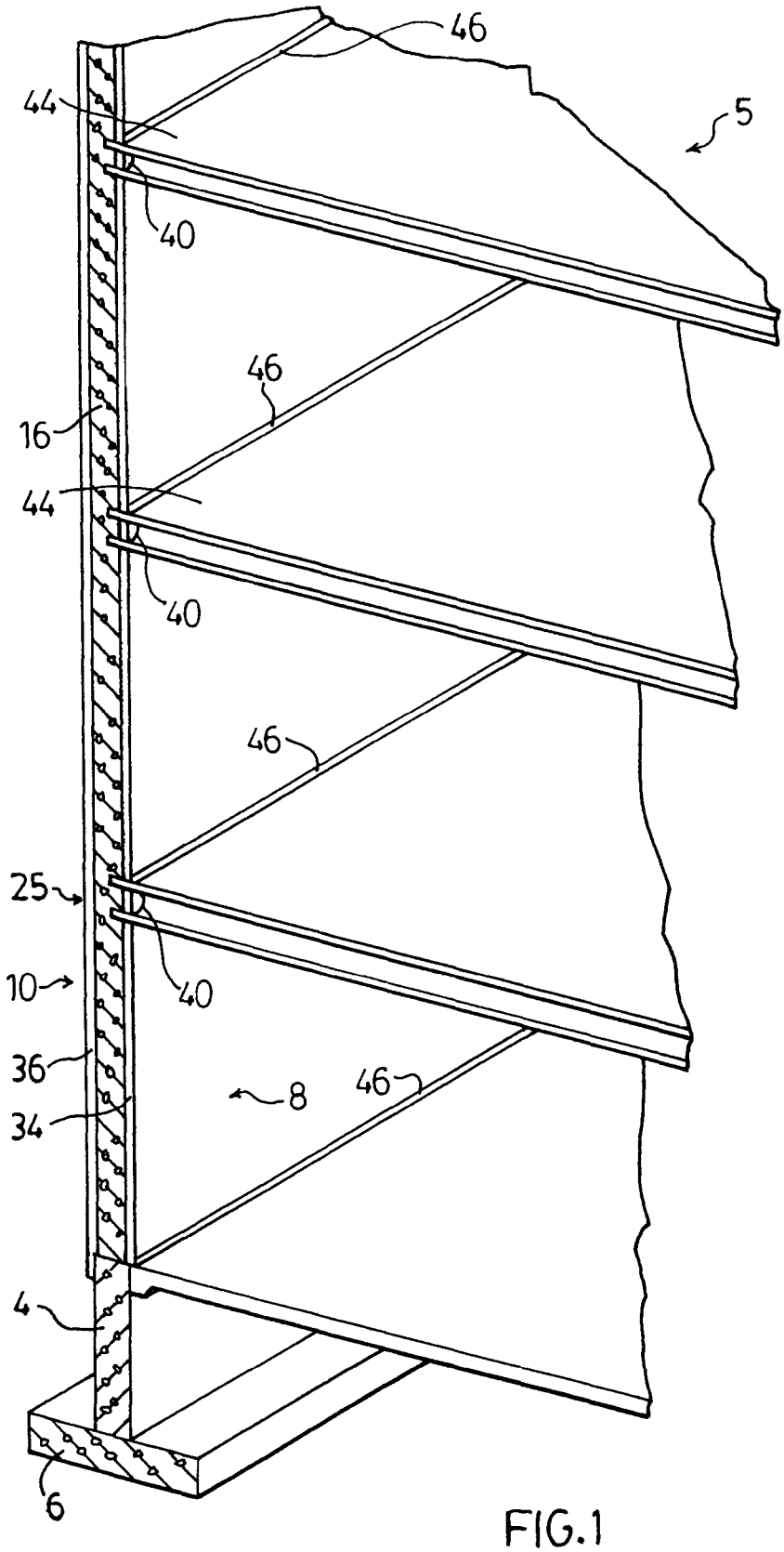
FIG. 1 illustrates a section of an ICF structure.

There is provided a method of constructing one or more storeys of a multi-storey insulated concrete form structure using insulated forms, an aspect of the method comprising erecting a set of forms comprising an inner form and an outer form a set distance apart, the outer form extending higher than the inner form when erected; pouring concrete between the forms upto an upper portion of the inner form and allowing the concrete to set creating a first concrete bearing surface; positioning a floor on the first concrete bearing surface above the inner form; and, pouring concrete between the floor and the outer form to an upper portion of the outer form and allowing the concrete to set creating a second bearing surface substantially in-line with the upper portion of the outer form.

The method may further comprise erecting a second set of forms on the upper portion of the outer form and a top surface of the floor; and, pouring concrete between the forms upto a top edge of an inner form of the second set of forms and allowing the concrete to set creating a third concrete bearing surface.

Alternatively, the method may further comprise before erecting the set of forms, cutting an upper section from the inner form about a thickness of the floor; and, cutting form ties joining the upper section to the outer form leaving a portion of the cut form ties attached to the outer form; whereby when the concrete is poured to create the second set bearing surface, the cut form ties attached to the outer form are embedded in the concrete.

There is provided a multi-story insulated concrete form structure constructed using the methods above.

There is provided a multi-storey insulated concrete form structure, in which a plurality of storeys comprise walls comprising outer insulated forms and inner insulated forms separated by a core of concrete; the walls supporting floors each positioned on a bearing surface of concrete substantially at a level of a top portion of an inner form immediately below the floor; a secondary surface comprising an inside surface of the outer form extending from the bearing surface to a top portion of the outer form, and an edge of the floor extending from the bearing surface to an upper surface of the floor, defining a secondary section of concrete; the secondary section of concrete joining the core of concrete of one storey with the core of concrete of an adjacent storey; the secondary surface affixed in place solely by bonding to the secondary section of concrete.

The multi-storey insulated concrete form structure may further comprise form ties embedded in the core of concrete, each tie connected to the inner surface of the outer form and an inner surface of the inner form; a secondary set of form ties connected to the secondary surface; and, the secondary set of form ties terminating in the secondary section of concrete without connection to the inner form; whereby the secondary set of form ties provide additional bonding of the secondary surface to the secondary section of concrete.

There is provided a multi-storey insulated concrete form structure, a plurality of storeys each comprising walls comprising outer insulated forms and inner insulated forms spaced apart by a gap, the gap filled with a core of concrete; the walls supporting a floor positioned on a bearing surface of concrete substantially at a level with an upper portion of an inner form immediately below the floor; the outer forms extending above the top portion of the inner forms; the core of concrete comprising two sections a lower section of concrete the full width of the gap, the upper extent of the lower section comprising the bearing surface, and an upper section of concrete extending from the upper extent of the lower section to an upper portion of the outer form and bounded by an inside surface of the outer form to an end of the floor, the upper section of concrete providing the sole fixation and support for the adjacent section of the outer form.

FIG. 1 illustrates a section of a portion of a multi-storey concrete structure 5. The concrete structure illustrated comprises a wall 25 supported by a foundation 4 located on a footing 6. The wall 25 comprises an inside form 8 and an outside form 10. Between the inside form 8 and an outside form 10 is a core 16 of concrete. The multi-storey concrete structure 5 includes multiple floors 44. The forms 8, 10 may either be single panels extending the full height of the storey, or alternatively, may comprise multiple panels stacked to reach the full height of the storey.

A method of ICF construction comprises pouring concrete one storey at a time. This method requires that the forms 8, 10 for the storey to be constructed be assembled upon the previously constructed storey. Generally, this requires using the previously constructed storey to fix and align the forms 8, 10 in preparation for the concrete pour. Since the ground-level storey is located proximate to the ground, standard ICF construction techniques may be used or techniques as described herein may be used. When constructing storey above the ground-level storey, the ground is no longer proximate to the forms under construction and accordingly techniques such as those described herein may be used.

Figure 2:
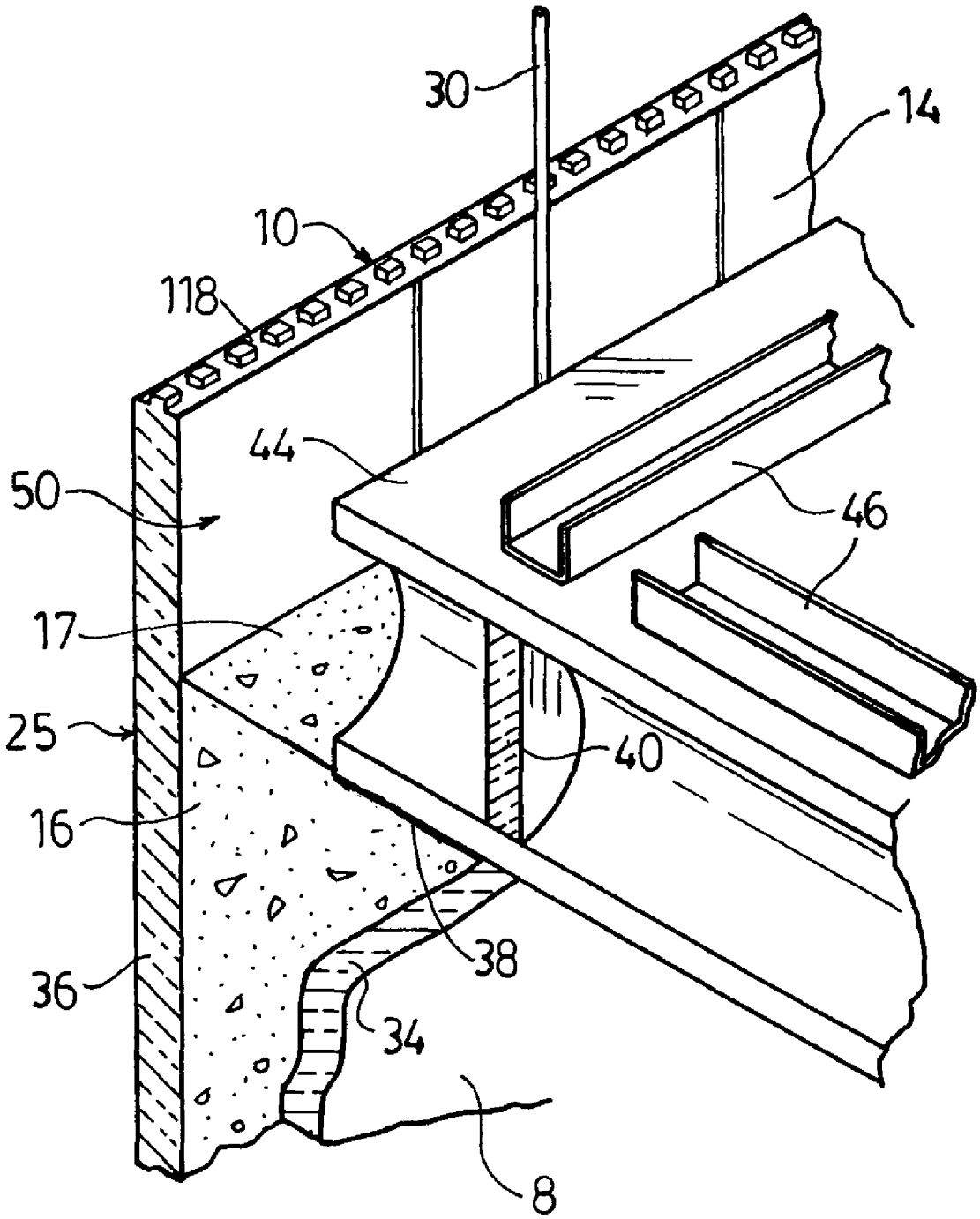
FIG. 2 illustrates a section of an ICF structure under construction after placement of a floor.
Figure 3:
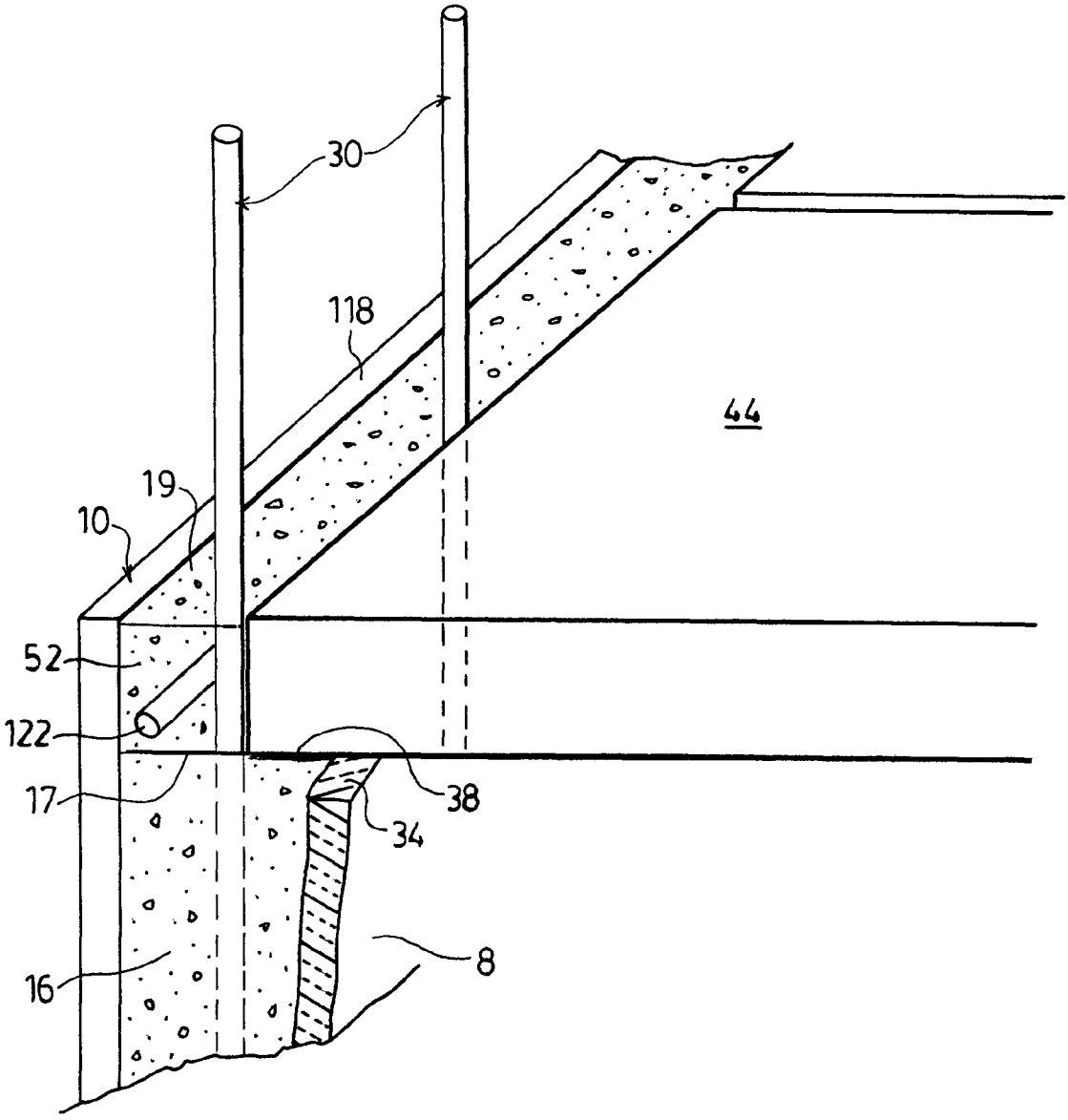
FIGS. 3, 4 and 5 illustrate a section of an ICF structure under construction according to an embodiment of a method of ICF construction.

After the forms 8, 10 have been fixed and aligned in place, using standard techniques for the ground-level storey or techniques such as those described herein for upper storeys, concrete may be poured up to an upper portion 34 of the inside form 8. Concrete agitators (not shown) may be used to remove voids from the fresh concrete. The concrete is then allowed to cure sufficiently to support the weight of a floor 44. A bearing pad 38, preferably made from masonite, may be located on the bearing surface 17 of the cured concrete as shown in FIG. 2. A floor 44 may then be positioned to rest on the bearing pad 38. Since the bearing pad 38 may create a gap between the upper portion 34 of the inside form 8 and the lower surface of the floor 44, insulating material such as sprayable foam may be inserted into the gap to maintain the thermal barrier provided by the inner form 8.

Bearing surface 17 is illustrated as planar and horizontal in the Figures. While this is a common configuration for the bearing surface 17, other configurations are possible including inclined surfaces for receiving inclined or arched floors.

FIG. 2 illustrates a section of a portion of a multi-storey concrete structure 5 during construction. At the stage in construction illustrated in FIG. 2, the concrete 16 has been poured upto a top portion 34 of the inside form 8 and the floor 44 is resting on a bearing pad 38 located on the bearing surface 17 of the core 16. A reinforcement bar 30 is fixed in the concrete 16 and extends upward to be embedded in a future concrete pour as construction progresses.

Since the inner form 10 is sized to accommodate placement of the floor 44, there is no corresponding portion of inner form 8 opposing the outer form 10 above the top portion 34 of the inner form. The top portion 34 of the inside form 8 and the top portion 118 of the outer form 10 may be offset to accommodate the floor 44 by either cutting the forms to shape at site, or by providing pre-cut asymmetrical forms that may be sized for a floor 44 of known thickness. FIG. 2 also includes guides 46 in place on the top of the floor 44 to receive the inner forms 8 of the next storey. Insulation discs 40 may be included to insulate any channels in the floor 44 before concrete is poured to secure the floor 44 in place.

After installation of the floor 44, there is a void 50 located above the bearing surface 17 of the core 16 and the end of the floor 44. The current storey of the structure 5 may be completed by pouring concrete into the void 50 upto the top portion 118 of the outer form 10 to fill the void with a secondary section of concrete 52. After the concrete in the secondary section 52 has set, the storey is complete and a new bearing surface 19 is created to receive the poured concrete for the next storey of forms 8, 10. The upper portion 118 of the lower storey outer form 10 is secured in place by bonding to the concrete in the secondary section 52.

A next storey of forms 8, 10 may then be positioned on the upper surface of the floor 44 and the upper portion 118 of the lower storey outer form 10. Since the upper portion 118 of the lower storey outer form 10 is secured in place by bonding to the concrete in the secondary section 52, a bottom portion 119 of the next story outer form 10 may be securely positioned and maintained in alignment during the next concrete pour.

The inner form 8 and outer form 10 are connected by a plurality of ties (not shown). Typically the ties are plastic and may have a hinged connection to the forms 8, 10 to allow the forms 8, 10 to stack flat for transport. Preferably remnants of the ties connected to the outer form 10 at the location of the void 50 are left in place to extend into the void 50. Accordingly, when the concrete is poured into the void to create a secondary section of concrete 52, the ties become embedded in the concrete and fix the outer form 10 in place.

By completing a storey with a secondary section 52 of concrete the upper portion 118 of the outer form 10 may be secured in place before pouring concrete for the next storey. Since the depth of the secondary section of concrete is roughly equivalent to the thickness of the floor 44, it is unlikely that the outer form 10 will become misaligned during the pour. After the secondary section of concrete has set, the outer form 10 is continuously supported along the upper portion 118 by the bonding to the secondary section.

Conversely, if the concrete pour for the next storey is used to fill the void 50, the hydrostatic pressure created by a full storey of concrete will press against the upper portion 118 of the outer form 10. In order to counteract this pressure, the upper portion 118 of the outer form 10 must be secured to fixed structures either in the core 16 of the previously poured storey, or to the floor 44. Securing the outer form 10 in this way is time consuming and prone to failure.

Accordingly, a two-step pour as described above results in a completed storey that provides a stable base for pouring the next storey of concrete that is more likely to result in multiple storeys being maintained in alignment than for a single pour technique. The two-step pour as described above also results in a completed storey comprising an outer form 10 that is secured in place at an upper portion 118 in-line with a bearing surface 19 for receiving the next concrete pour.

By filling in the void 50 prior to constructing the next storey, it is not generally necessary to further support or fix the outer form 10 as the concrete in the secondary section 52 bonds with the form 10. Since the void 50 is a relatively small volume, the outer form 10 is sufficiently rigid to maintain alignment while pouring concrete to fill the void 50.

A further advantage of a two-step pour is that corrections to the alignment of the outer form 10 can be made before the pour for the next storey by using one or more adjustments anchored in the floor, or horizontal supports tied to the reinforcement bar 30, to correct the alignment of the outer form 10 before its alignment has been set by the concrete in the secondary section 52. In this fashion after the core 16 has set, an assessment can be made to determine if any corrections to alignment need to be made. Alignment may be corrected with the adjustments, prior to the second pour to complete the secondary section 52 of concrete. Since the volume of the void 50 is relatively small, the adjustments may correct alignment without having to bear the pressure of a full storey pour. While such corrections are generally not necessary, in situations where the alignment needs to be corrected, the flexibility of providing for a correction is provided.

The resulting structure, having a bearing surface 19 substantially in-line with the upper upper portion 118 of the outer form 10 provides support for the outer form 10 that is able to resist the hydrostatic pressure imparted on the form 10 when the next storey is poured.

Figure 4:
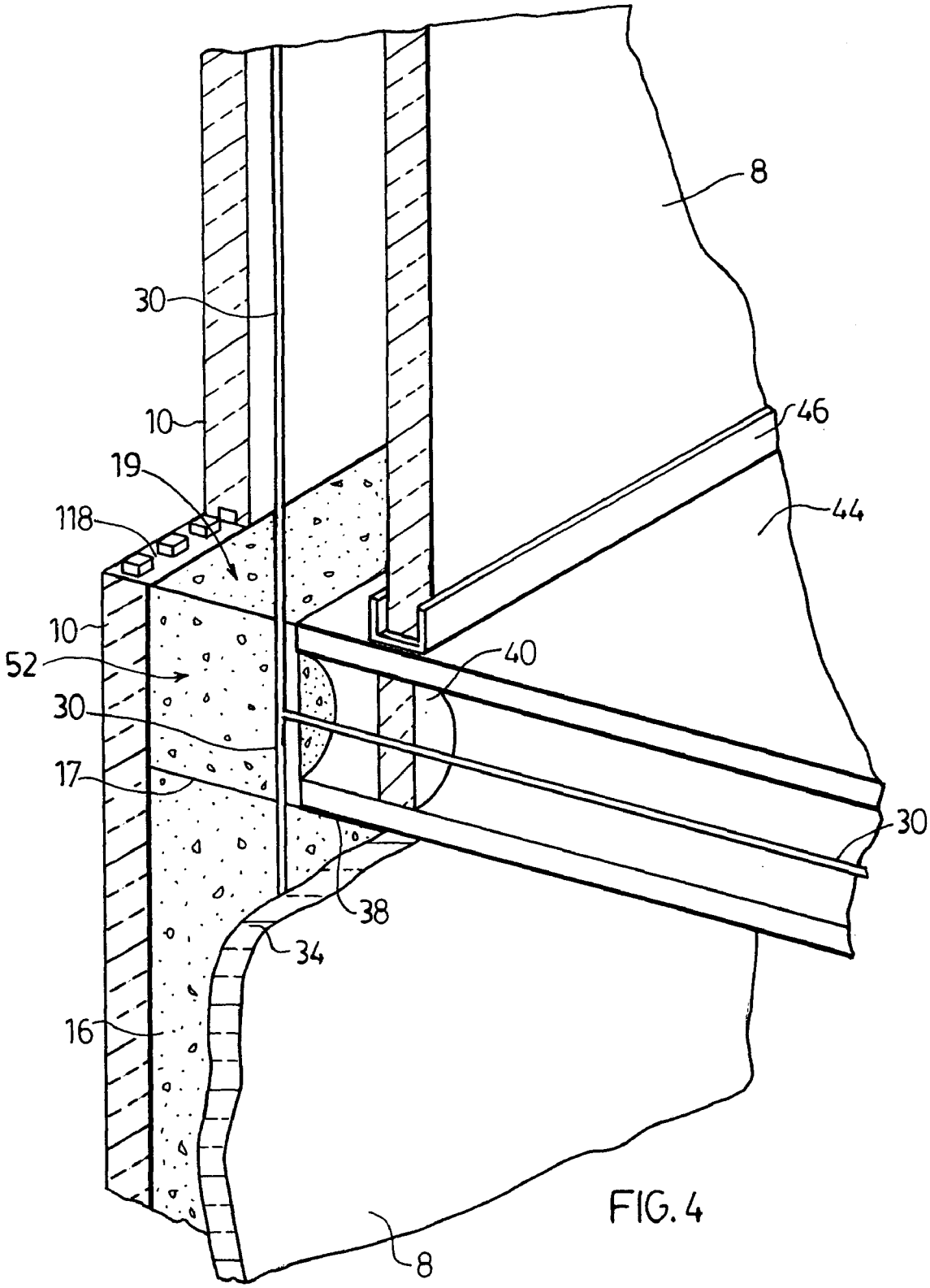

FIG. 4 is an illustration of the structure of FIG. 2 with the next storey of forms 8, 10 in place for a concrete pour. The void 50 has been filled with concrete creating a secondary section 52 of concrete. As illustrated, a reinforcement bar 30 may extend from the concrete 16 in the lower storey through the floor 44 and a reinforcement bar 30 may extend through the floor 44 through the gap to be filled with concrete in the upper storey. In this fashion, the floor 44 may be tied in and secured into the structure 5. As described above, the next storey of forms 8, 10 need not be installed for the step of pouring concrete to fill the void 50.

A guide 46, illustrated in FIGS. 2 and 4, is positioned on the top surface of the floor 44 to guide and locate the inner form of the upper storey. The guide 46 may be a symmetrical U as illustrated, or may be an asymmetrical J-shape extending higher on one side of the form 8 than the other to accommodate fasteners inserted through the guide into the form 8 from the inside edge 47 of the guide 46. Typically the inside edge 47 of the guide 46 is secured to the inner form 10 with screws. Where a structure comprises a continuous vertical wall, the guides 46 of one storey are typically vertically aligned with the corresponding guides 46 of the other storeys in the structure.

Figure 5:
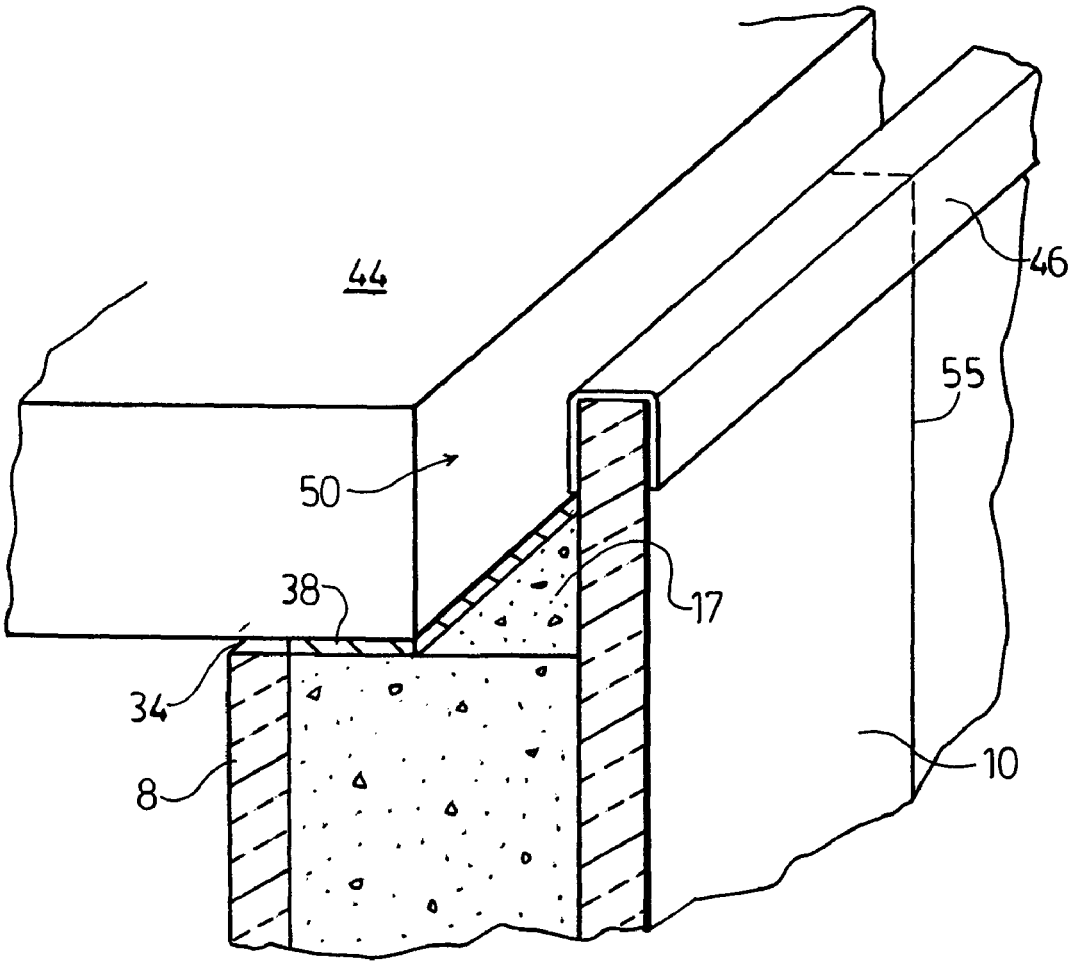

Optionally, prior to filling the void 50 with concrete, a guide 46 may be used to assist in maintaining adjacent outer form 10 panels in alignment. As illustrated, in FIG. 5, the guide 46 has a U-shaped or J-shaped profile and may be positioned with its open side facing down towards the upper portion 118 of the outer form 10. The guide 46 may be positioned down over the upper portion 118 of the outer form 10 across a joint 55 between adjacent panels. Once the guide 46 is in place the concrete may be poured to fill the void 50. After the concrete has sufficiently set, the guide 46 may be removed from the outer form 46 and fixed to the top surface of the floor 44 with open side facing up to receive the inner form 8 for the next storey. While it is not necessary to re-use the guide 46, the re-use provides a convenient method for building the structure 5 that only requires sufficient materials for each storey, rather than supplying additional guides 46 to align the inner forms 8 of the next storey.

I claim:

1. A method of constructing one or more storeys of a multi-storey insulated concrete form structure using insulated forms, the method comprising:

erecting a set of forms comprising an inner form and an outer form a set distance apart, the outer form extending higher than the inner form when erected;

pouring concrete between the forms upto an upper portion of the inner form and allowing the concrete to set creating a first concrete bearing surface;

positioning a floor on the first concrete bearing surface above the inner form; and, pouring concrete between the floor and the outer form to an upper portion of the outer form and allowing the concrete to set creating a second bearing surface substantially in-line with the upper portion of the outer form.

2. The method of claim 1 further comprising:

erecting a second set of forms on the upper portion of the outer form and a top surface of the floor; and, pouring concrete between the forms upto a top edge of an inner form of the second set of forms and allowing the concrete to set creating a third concrete bearing surface.

3. The method of claim 1 further comprising:

before erecting the set of forms, cutting an upper section from the inner form about a thickness of the floor; and, cutting form ties joining the upper section to the outer form leaving a portion of the cut form ties attached to the outer form;

whereby when the concrete is poured to create the second set bearing surface, the cut form ties attached to the outer form are embedded in the concrete.

4. A multi-story insulated concrete form structure constructed using the method of claim 1.

* * * * *